US007651024B2

(12) United States Patent
Barner

(10) Patent No.: US 7,651,024 B2
(45) Date of Patent: Jan. 26, 2010

(54) REINFORCED BULK BIN AND METHODS FOR MAKING SAME

(75) Inventor: James Watson Barner, Cummings, GA (US)

(73) Assignee: Smurfit-Stone Container Enterprises, Inc., Chicago, IL (US)

( * ) Notice: Subject to any disclaimer, the term of this patent is extended or adjusted under 35 U.S.C. 154(b) by 0 days.

(21) Appl. No.: 11/476,271

(22) Filed: Jun. 28, 2006

(65) Prior Publication Data

US 2006/0273145 A1 Dec. 7, 2006

Related U.S. Application Data

(62) Division of application No. 10/785,147, filed on Feb. 24, 2004, now Pat. No. 7,094,194.

(51) Int. Cl.
*B65D 5/62* (2006.01)

(52) U.S. Cl. ..... 229/199; 229/164.1

(58) Field of Classification Search ..... 229/109, 229/199, 87.18, 164.1; 206/386, 600
See application file for complete search history.

(56) References Cited

U.S. PATENT DOCUMENTS

| | | | | |
|---|---|---|---|---|
| 915,455 | A | 3/1909 | Lynch, Jr. | |
| 1,044,023 | A | 11/1912 | Colgate | |
| 1,139,281 | A | 5/1915 | Hazelton | |
| 1,794,821 | A | 3/1931 | Andrews | |
| 2,163,656 | A | 6/1939 | Adkisson | |
| 2,216,527 | A | 10/1940 | Weiss et al. | |
| 2,337,370 | A | 12/1943 | Broadfoot | |
| 2,502,586 | A | 4/1950 | Ottinger | |
| 2,611,526 | A | 9/1952 | George | |
| 2,651,447 | A * | 9/1953 | Seaborne | 229/199 |
| 2,722,361 | A | 11/1955 | Kindseth | |
| 2,766,926 | A | 10/1956 | Thompson | |
| 2,904,238 | A | 9/1959 | Perry et al. | |
| 3,123,254 | A | 3/1964 | Rabby et al. | |
| 3,257,068 | A | 6/1966 | Wright | |
| 3,261,533 | A | 7/1966 | Repking | |
| 3,423,009 | A | 1/1969 | Palmer | |
| 3,653,578 | A | 4/1972 | Wood | |
| 3,779,448 | A | 12/1973 | Wootten | |
| RE28,439 | E | 6/1975 | Shepherd | |
| 3,896,991 | A | 7/1975 | Kozlowski et al. | |
| 3,937,392 | A | 2/1976 | Swisher | |
| 3,945,493 | A | 3/1976 | Cardinal | |
| 3,957,195 | A | 5/1976 | Lin | |
| 4,013,168 | A | 3/1977 | Bamburg et al. | |
| 4,082,216 | A | 4/1978 | Clarke | |
| 4,115,909 | A | 9/1978 | Corella | |
| 4,176,748 | A | 12/1979 | Beane | |
| 4,226,327 | A | 10/1980 | Ballard | |
| 4,308,905 | A | 1/1982 | Gallagher | |
| 4,337,888 | A | 7/1982 | Kudalkar | |

(Continued)

*Primary Examiner*—Gary E Elkins
(74) *Attorney, Agent, or Firm*—Armstrong Teasdale LLP

(57) ABSTRACT

A reinforced bulk bin, and methods for making same, wherein a collapsible bulk bin, preferably fabricated from paper, paperboard and/or corrugated paperboard, is provided with a reinforcing plastic sleeve, which is placed on the bin while in its collapsed configuration. When in place, and prior to the bin being deployed, the sleeve is under tension. When the bin is deployed, the sleeve exerts restraining force, distributed over the surfaces of the side walls of the bin. The sleeve may be positioned on the collapsed bin either manually or mechanically.

12 Claims, 9 Drawing Sheets

U.S. PATENT DOCUMENTS 4,362,199 A 12/1982 Futerman
RE31,191 E 3/1983 Connolly
4,392,606 A * 7/1983 Fremion ..... 229/199
4,452,837 A 6/1984 Clausen et al.
4,622,693 A 11/1986 Mykleby
4,655,366 A * 4/1987 Sykes ..... 229/199
4,666,059 A 5/1987 Nordstrom
4,702,408 A 10/1987 Powlenko
4,745,863 A 5/1988 Takezaki
4,793,550 A 12/1988 Gottlieb
4,850,506 A * 7/1989 Heaps et al. ..... 229/109
RE33,128 E 12/1989 Nordstrom
4,890,652 A 1/1990 Hoerner
4,903,431 A 2/1990 Stoll
4,903,859 A 2/1990 Derby et al.
4,979,547 A 12/1990 Hoerner
4,997,125 A 3/1991 Glerum
5,028,147 A 7/1991 Graham
5,069,359 A 12/1991 Liebel
5,129,609 A 7/1992 Tobin
5,158,369 A 10/1992 Derby
5,165,568 A 11/1992 Wischusen, III
5,285,957 A 2/1994 Halsell
5,340,217 A 8/1994 Rothman
5,351,849 A 10/1994 Jagenburg et al.
5,353,982 A 10/1994 Perkins et al.
5,405,006 A 4/1995 Burgdorf et al.
5,518,168 A 5/1996 Mayer
5,566,531 A 10/1996 Nordstrom et al.
5,743,422 A 4/1998 Hale
5,758,973 A 6/1998 LaFleur
5,759,644 A 6/1998 Stanley
5,772,108 A 6/1998 Ruggiere, Sr. et al.
5,813,562 A 9/1998 Perkins
6,000,549 A 12/1999 Perkins
6,074,331 A 6/2000 Ruggiere, Sr. et al.
6,145,686 A 11/2000 Stinson
6,164,453 A 12/2000 Perkins
6,203,198 B1 3/2001 Stone
6,244,443 B1 6/2001 Nickell et al.
6,394,277 B2 5/2002 Nickell et al.
6,415,927 B1 7/2002 Stone et al.
6,431,435 B1 * 8/2002 Jones et al. ..... 229/109
6,513,703 B2 2/2003 Becker
6,516,965 B1 2/2003 Perkins
6,575,629 B1 6/2003 Perkins
6,688,084 B2 * 2/2004 Yarbrough ..... 53/589

* cited by examiner

REINFORCED BULK BIN AND METHODS FOR MAKING SAME

CROSS-REFERENCE TO RELATED APPLICATIONS

This application is a divisional of U.S. patent application Ser. No. 10/785,147, filed Feb. 24, 2004 now U.S. Pat. No. 7,094,194, which is hereby incorporated by reference and is assigned to assignee of the present invention.

BACKGROUND OF THE DISCLOSURE

1. Field of the Invention

The present invention relates in general to bulk bins for transportation of goods, particularly bulk bins fabricated from paper, paperboard and/or corrugated paperboard. The present invention also relates to such bulk bins which are collapsible, when not actually In use transporting goods.

2. Background Art

Collapsible bulk bins, that are fabricated from single- or multi-thickness wall corrugated paperboard material, are known. Such bins are typically formed from a blank, having a first end and a second end, wherein the blank is divided by vertically extending parallel fold lines or creases into a plurality of wall panels. One or two additional wall panels are disposed at one or both ends, so that when the blank is folded into a tube, wall panels at opposite ends of the blank overlap to form a manufacturer's joint. Emanating from the bottom edges of several or each of the side walls are bottom flaps or panels which are configured to be overlapped, to form a bottom wall of the bin. These panels, while overlapping, may not completely cover all of the available area of the "bottom" of the bin, and typically are not adhered to one another, so that once the bin has completed one cycle of use (raised, filled, transported), the bottom panels can be unfolded, and the bin flattened, for transportation. Such bins are usually erected, on top of a pallet or skid sheet, and then filled with product for shipping.

Depending upon the kind, shape, density and per unit weight of the articles that are placed in the bin, fully loaded, the sides of the bin may bulge, leading to spilling of product, structural degradation issues, as well as effectively increasing the "footprint" of each bin.

Accordingly, various methods have been devised for reinforcing the sides of such bulk bins, to reduce bulging and/or otherwise strengthen the bins. Such methods have included the use of plastic girdling straps (usually 5 or so), strings (as many as sixteen), wrapping the raised and/or filled bulk bin with plastic wrap, or providing tape (referred to as "sesame" tape) that is laminated into the corrugated material. Each of these methods, while effective in providing reinforcement, may be undesirable for one or more reasons, such as increased material and/or manufacturing costs (such as the sesame tape), or increased overall operational costs and/or setup time/steps. In addition, in many of these designs, particularly those that involve the placement of external reinforcement (plastic strapping, wound plastic wrap or strings), because the reinforcement is provided after the bin has been raised, the reinforcement members' force is directed typically mostly on the corners of the bin, and not on the bulging sidewall surfaces.

It would be desirable to provide a reinforced bulk bin construction for collapsible bulk bins of the type fabricated in whole or in part, from corrugated paperboard materials, which is simple in form, and which does not significantly increase material and manufacturing costs.

It would also be desirable to provide a reinforced bulk bin construction wherein the reinforcement "force" is more evenly distributed about the sidewalls of the bulk bin.

These and other desirable characteristics of the invention will become apparent in view of the present specification, claims and drawings.

SUMMARY OF THE INVENTION

The present invention comprises, in part, a composite, reinforced, collapsed bulk bin assembly capable of being erected to a deployed, articulated configuration. The bulk bin assembly comprises a bulk bin body, having at least one bottom panel, and a plurality of side walls, operably configured to be disposed substantially perpendicular to the at least one bottom panel, when the bulk bin body is in a deployed configuration. The bulk bin body is positioned in a collapsed configuration, wherein some of the side walls are disposed in juxtaposed, overlying, parallel orientation relative to remaining ones of the side walls. At least one substantially stretchable reinforcing sleeve is disposed about the plurality of side walls, wherein the reinforcing sleeve is snugly attached about the bulk bin body, when the bulk bin body is in its collapsed configuration, and further wherein when the bulk bin body is in its collapsed configuration, the reinforcing sleeve is stretched, relative to an at-rest, unstressed state of the reinforcing sleeve.

The reinforcing sleeve is preferably stretched, when the composite, reinforced collapsible bulk bin is in its erected configuration, an amount of one to two percent, inclusive, of its at-rest, unstressed circumference.

Preferably, the bulk bin body is fabricated from at least one of paper, paperboard, corrugated paperboard. Likewise, preferably, the reinforcing sleeve is fabricated from a substantially stretchable material comprised of at least one of polyethylene, polypropylene.

In an embodiment of the invention, the reinforcing sleeve is monolithically formed as a single extruded member, cut off from a continuous tubular extrusion of reinforcing sleeve material. In an alternative embodiment of the invention, the reinforcing sleeve is provided with two seams extending in a direction substantially parallel to a vertically extending direction along the side walls of the bulk bin body.

Preferably, the composite, reinforced collapsed bulk bin assembly is configured so that when the bulk bin body is in its deployed, fully articulated configuration, it has a polygonal cross-section.

The present Invention also comprises, in part, a method for making a composite, reinforced collapsed bulk bin assembly, capable of being erected to a deployed, articulated configuration, comprising the steps of:

providing at least one blank, operably configured to form, upon articulation and adhesion along a manufacturer's joint thereof, a collapsed bulk bin body;

articulating and adhering the at least one blank, along the manufacturer's joint to provide a bulk bin body, with at least one bottom panel and a plurality of side walls, operably configured to be disposed substantially perpendicular to the at least one bottom panel, when the bulk bin body is in a deployed configuration, positioning the bulk bin body in a collapsed configuration, wherein some of the side walls are disposed in juxtaposed, overlying, parallel orientation relative to remaining ones of the side walls, providing at least one substantially stretchable reinforcing sleeve, the at least one reinforcing sleeve being formed with a tubular portion, having a longitudinal axis and a circumference which, when the tubular portion is flattened and in an unstressed state, is less than an external circumference of the bulk bin body, when the bulk bin body is In a flat, collapsed configuration;

placing the at least one reinforcing sleeve, snugly about the plurality of side walls, of the bulk bin body, when the bulk bin body is in its collapsed configuration, so that when the at least one reinforcing sleeve is in position about the plurality of side walls of the bulk bin body, the reinforcing sleeve is slightly stretched, relative to an at-rest, unstressed state of the reinforcing sleeve.

The method preferably further comprises the step of placing the reinforcing sleeve into a stretched configuration, in the amount of one to two percent, inclusive, of its at-rest, unstressed circumference, when the reinforcing sleeve is in place on the erected bulk bin body.

The method preferably further comprises the step of fabricating the bulk bin body from at least one of paper, paperboard, corrugated paperboard. The method also preferably further comprises the step of fabricating the reinforcing sleeve from a substantially stretchable material comprising at least one of polyethylene, polypropylene.

The method, in one embodiment of the invention, further comprises the step of monolithically forming the reinforcing sleeve as a single extruded member, cut off from a continuous tubular extrusion of reinforcing sleeve material. In an alternative embodiment of the invention, the method further comprises the step of forming the reinforcing sleeve with two seams extending in a direction substantially parallel to a vertically extending direction along the side walls of the bulk bin body.

The method preferably further comprises the step of configuring the bulk bin body, when in its deployed configuration, to have a polygonal cross-section.

In an embodiment of the invention, the step of placing the at least one reinforcing sleeve onto the bulk bin body comprises the steps of:

bowing the collapsed bulk bin body, so that a chord distance between opposing edges of the bowed, collapsed bulk bin body is substantially less than a corresponding distance between opposed edges of the collapsed bulk bin body, when in an at-rest, unstressed configuration;

sliding the at least one reinforcing sleeve onto the bowed, collapsed bulk bin body;

releasing the bowed, collapsed bulk bin body, to permit it to reconfigure toward its at-rest, unstressed configuration.

In an alternative embodiment of the invention, the step of placing the at least one reinforcing sleeve onto the bulk bin body comprises the steps of:

applying a force to the reinforcing sleeve to stretch the reinforcing sleeve in a direction transverse to the longitudinal axis;

sliding the stretched reinforcing sleeve over the plurality of side walls of the collapsed bulk bin body;

removing the stretching force from the reinforcing sleeve.

DETAILED DESCRIPTION OF THE INVENTION

Figure 1:
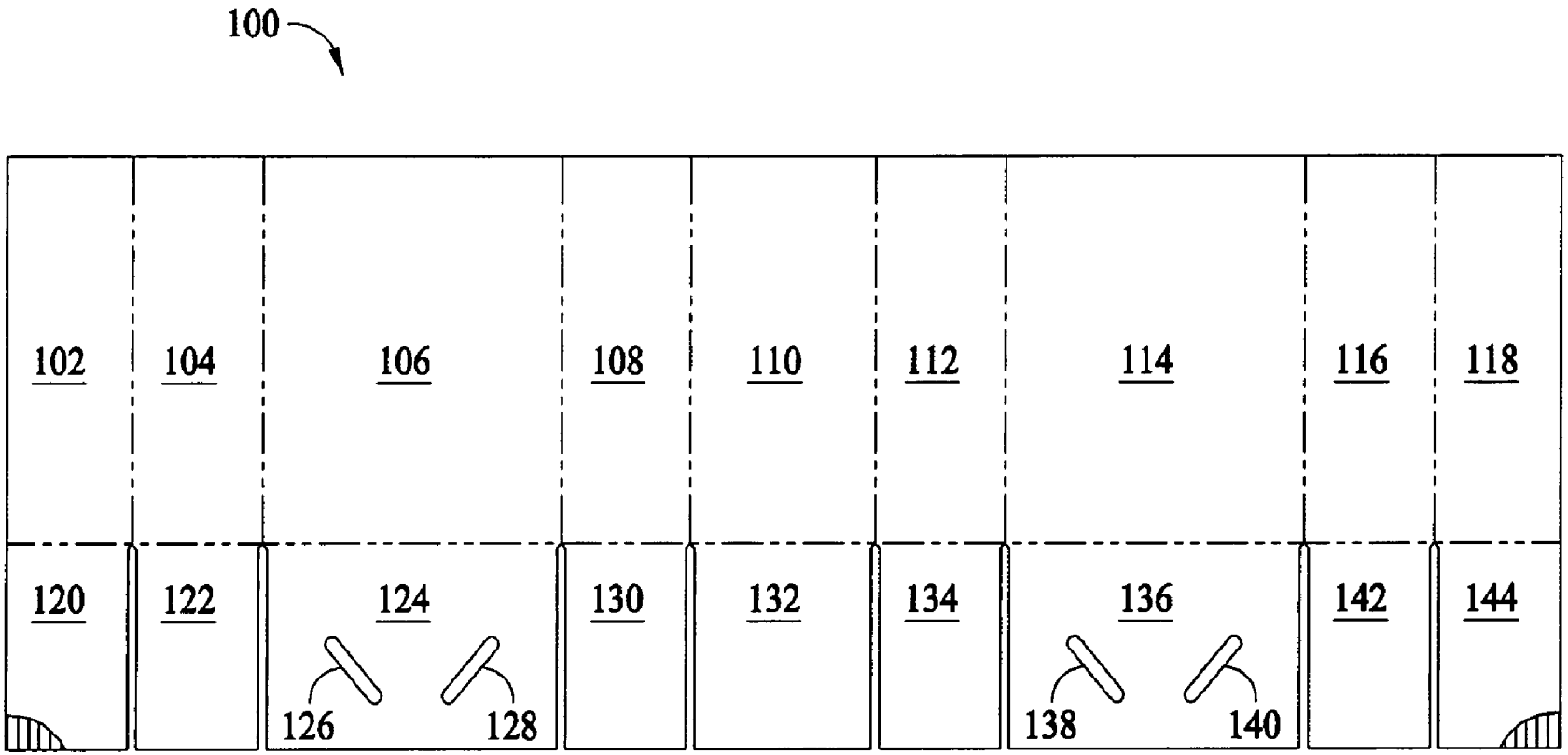
FIG. 1 is a plan view of a blank for forming an octagonal bulk bin, which may be used in accordance with the principles of the present invention.

While this invention is susceptible of embodiment in many different forms, there is shown in the drawings and will herein be described in detail, a preferred embodiment with the understanding that the present disclosure should be considered as an exemplification of the principles of the invention and is not intended to limit the invention to the embodiment so illustrated.

When referring to the plan illustrations of the blanks, the usual drawing conventions for structures fabricated from paper, paperboard and/or corrugated paperboard, are applied. That is, unless otherwise noted, broken lines indicate fold lines, scores, crease or the like; scalloped lines indicate cut or perforation-like lines of weakness forming a tear strip or similar structure; and solid lines on the interior of a blank indicate through-cuts, forming openings or fully separating one portion of the blank from an adjacent portion of the blank.

FIG. 1 illustrates an otherwise conventional blank 100 for a typical octagonal (once raised) collapsible bulk bin. Blank 100 may be fabricated from any suitable material, typically paper, paperboard and/or corrugated paperboard material. The principles of the present invention may also be applied to bulk bins fabricated from other similar-performing materials such as plastic, particularly corrugated plastic material. Blank 100 (reference numeral 100 will also be used to refer to the folded and glued blank which results in a collapsed bulk bin) includes wall panels 102, 104, 106, 108, 110,112, 114, 116 and 118, and bottom flaps 120, 122, 124, 130, 132, 134, 136, 142, 144. In order to form a collapsible bulk bin from blank 100, the sum total width of wall panels 102 and 118 is greater than the width of panel 110, which would form the opposing panel, once the bin is erected. Blank 102 is folded into a tube, and panels 102 and 118 are overlapped slightly and glued together.

Figure 2:
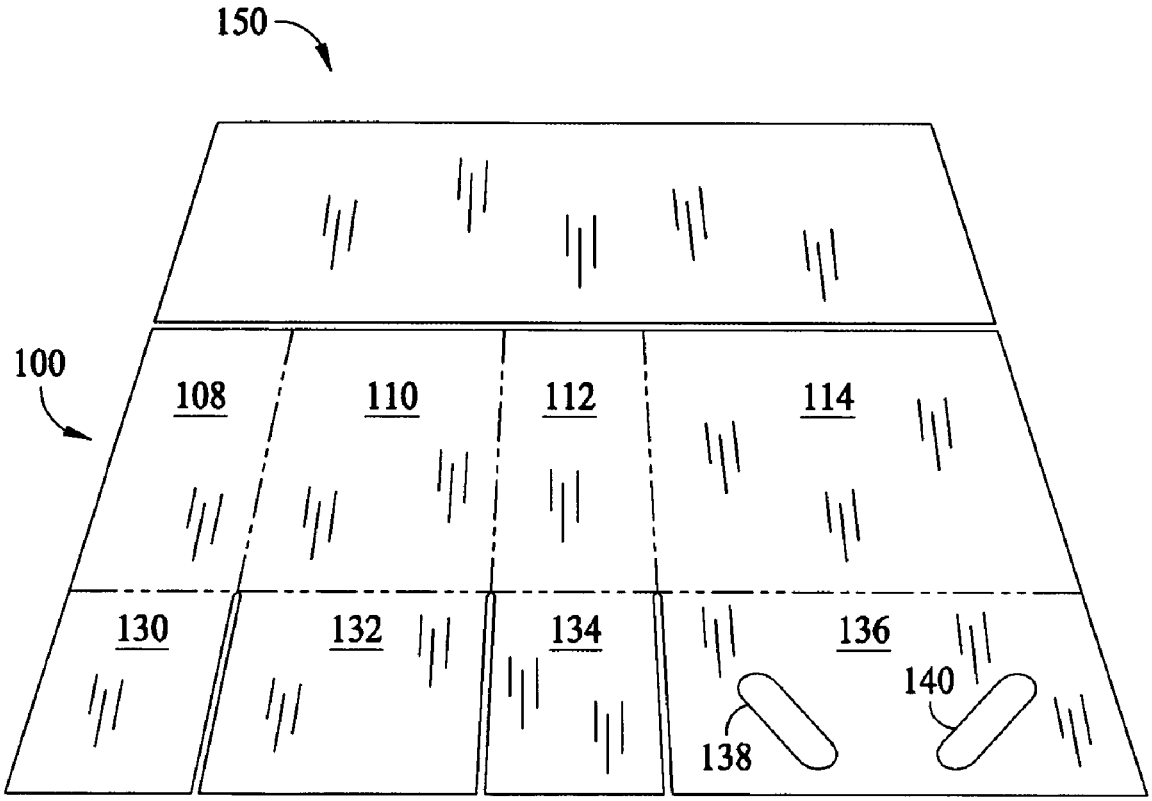
FIG. 2 is a perspective view of a blank according to the embodiment of FIG. 1, which has been folded, glued and flattened to form a collapsed bulk bin container, prior to having a plastic sleeve placed thereon, In accordance with the principles of the invention.

Collapsed bin 100 can then be flattened, as shown in FIG. 2, for transport and/or for placement of plastic sleeve 150. In that configuration, panels 108, 110, 112, 114 (visible in FIGS. 2-4) overlie, in order from left to right, panels 106, 104, 102-118, 116. Bottom panels 130, 132, 134 and 136 overlie, in order from left to right, panels 124, 122, 120-144, 142. Bottom panels 124 and 136 contain slots 126, 128, 138, 140. To close the bottom of bin 100, if desired, bin 100 is inverted. Panels 122, 130, 134 and 142 are folded perpendicular to the side walls and across the bottom opening of the bin 100. Then, panels 124 and 136 are folded across the bottom of bin 100. Then, finally, panels 132 and 120/144 (which are overlapped and glued together when side walls 102 and 118 are overlapped and glued together) are folded over, and their respective corners inserted into slots 128, 138 and 124, 140, respectively.

In order to provide reinforcement for bulk bin 100, plastic sleeve 150 is provided. Sleeve 150 may be fabricated preferably from polyethylene or polypropylene, though other materials, having suitable performance characteristics, as discussed herein, may be employed. Sleeve 150 may be a monolithically formed, unseamed sleeve, that has been cut to a desired length from a continuous extrusion. Alternatively, the sleeve 150 may be formed by taking the cut off portions of the extrusion, flattening the cut-off portion, sealing (seaming) closed the open ends of the cut off portion, and then slitting the sides of the flattened tube that extend between the just-formed seams. This may be performed in order to take advantage of different performance characteristics of the plastic material that arise when the material is rotated 90 degrees from the extrusion direction, if the plastic material is one that has direction-specific strength or other performance characteristics. When a seamed sleeve 150 is in place on an erected bin, the sleeves will run vertically. Sleeve 150 may be transparent, translucent, or opaque. Advertising indicia may be printed on it. Sleeve 150 may be fabricated from material that is resistant to the transmission of moisture. Alternatively (depending upon the material to be shipped in the bin—which may be placed in a surrounding bag), sleeve 150 may be provided with perforations of a selected size, to permit the passage of moisture vapor out of the bulk bin.

When sleeve 150 is in an untensioned configuration, it has a circumference which is less than the outside circumference of bulk bin 100, when it is in its collapsed configuration. Accordingly, in order to place sleeve 150 onto collapsed bulk bin 100, either sleeve 150 must be slightly stretched, or the effective distance required to encircle a collapsed bulk bin 100 must be reduced.

Figure 3:
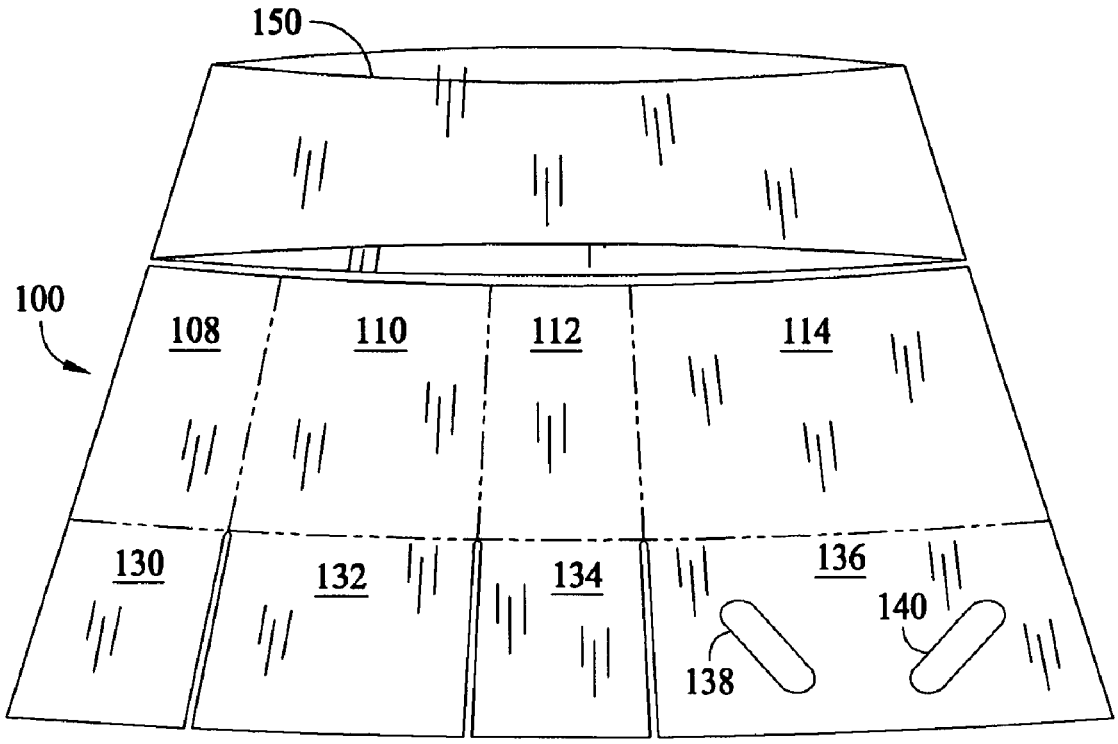
FIG. 3 is a perspective view of the collapsed bulk bin of FIG. 2, shown bowed, for insertion into a slightly opened plastic sleeve, according to a manual process for formation of the reinforced bulk bin of the present invention.
Figure 4:
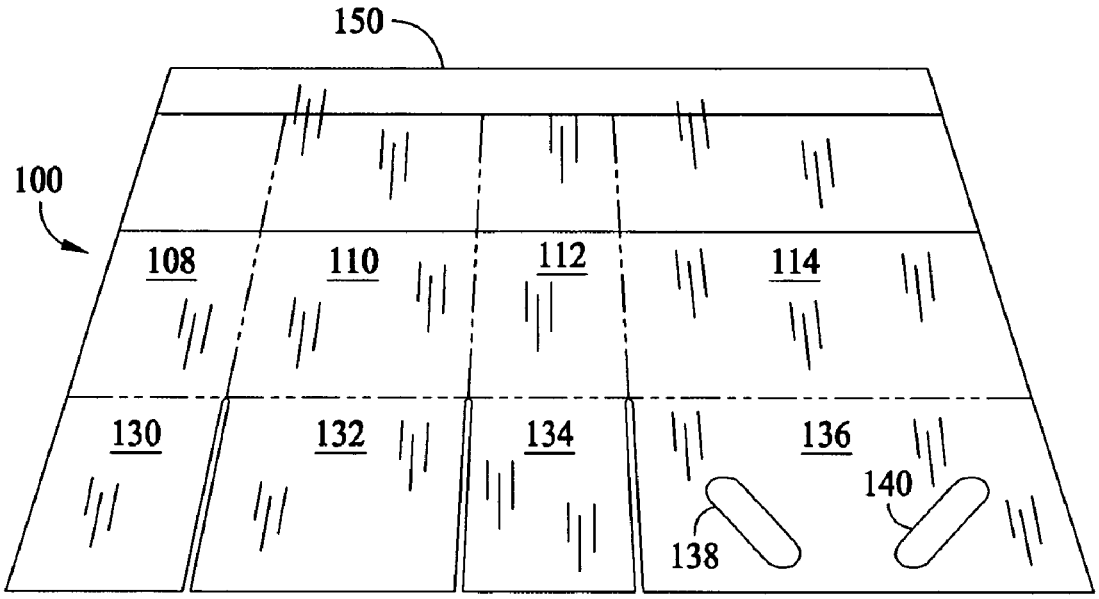
FIG. 4 is a perspective view showing the plastic sleeve partially slid onto the collapsed bulk bin of FIGS. 2 and 3.

A first method of placement of sleeve 150 onto bulk bin 100 is illustrated in FIG. 3. This method, which may be accomplished either manually, or by machinery (which may be so suitably adapted by one of ordinary skill in the art having the present disclosure before them), is to reduce the distance required to encircle a collapsed bulk bin 100, by bowing the collapsed bin 100, thus making the shortest distance around collapsed bulk bin 100 equal to the sum of the arcuate distance along the convex surface of the bowed bin, plus the straight-line chord distance between the opposing edges of the bowed bin. By sufficient bowing, and holding the end of sleeve 150 opened, bin 100 may be inserted into sleeve 150, potentially (depending upon the difference between the relative at-rest circumferences of the sleeve and the bin) without initially stretching sleeve 150 at all.

When the force causing bin 100 to be bowed is released, as it straightens out, a small amount of tension is then applied to sleeve 150. It is desirable that the material from which sleeve 150 is fabricated will not experience "creep" while under tension, or at least will undergo "creep" sufficiently slowly that the composite bin with sleeve may be used for several loading and shipping cycles, before a new sleeve is needed.

Preferably, sleeve 150 is open at both ends, and has a "height" which approximately the same or slightly less than the height of bulk bin 100, when it is erected. Alternatively, a sleeve may be provided that is like an open-bottomed envelope, having a sealed top edge, which can prevent the intrusion of moisture into the top end region of the collapsed bulk bin, until the bin is ready for use. The top can then be slit, permitting the bulk bin to be opened up, the bottom flaps folded and slotted into place, and the bin loaded with goods for shipment.

It is believed that by placing sleeve 150 onto bin 100 prior to bin 100 being erected, when the bin is erected, the tension in sleeve 150 results in a more evenly distributed force acting on the surfaces of the side walls, and not just on the "corner" areas that are created when the bin is opened up.

Figure 5:
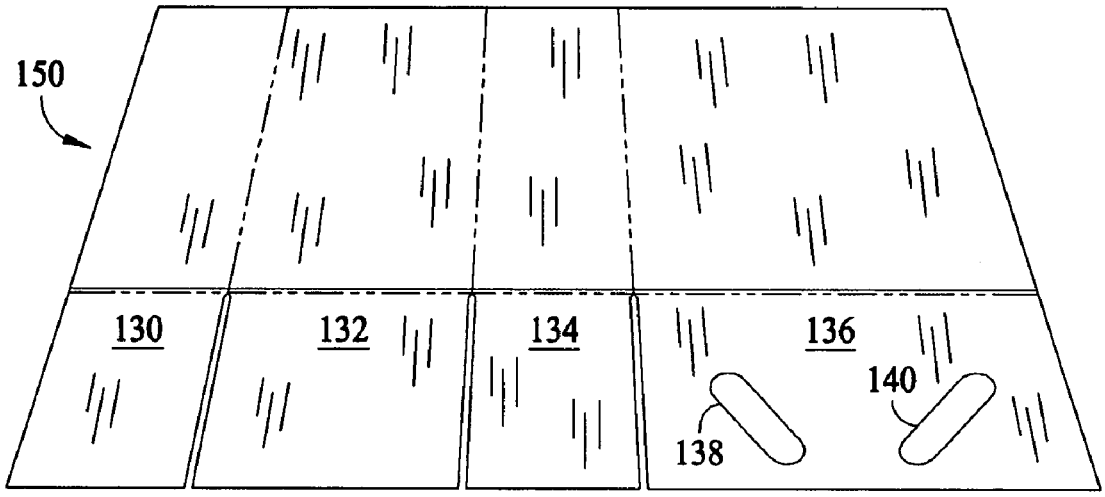
FIG. 5 is a perspective view showing the plastic sleeve fully slid onto the collapsed bulk bin of FIGS. 2-4.
Figure 6:
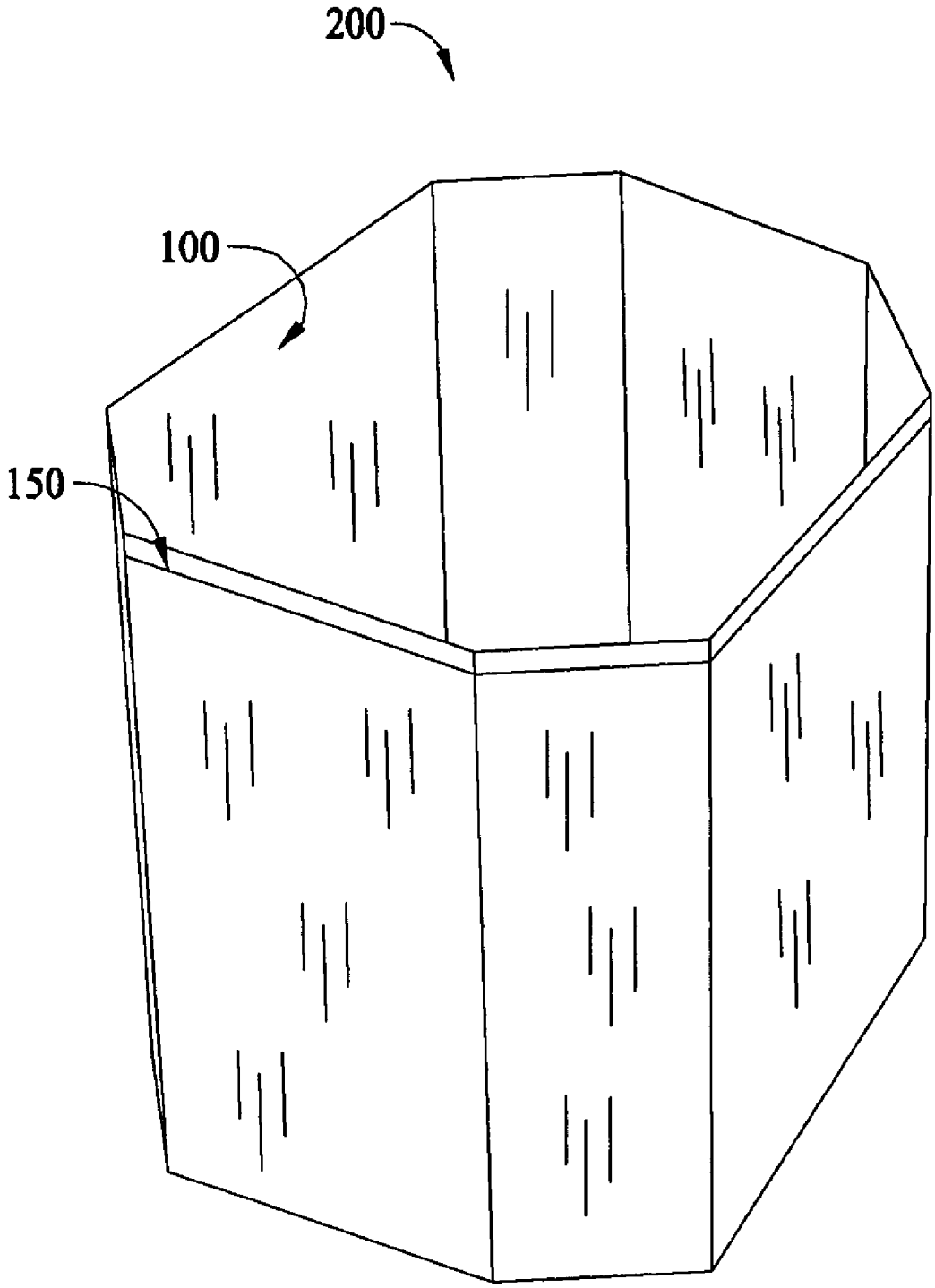
FIG. 6 is a perspective view of the erected bulk bin with plastic sleeve in place.
Figure 7:
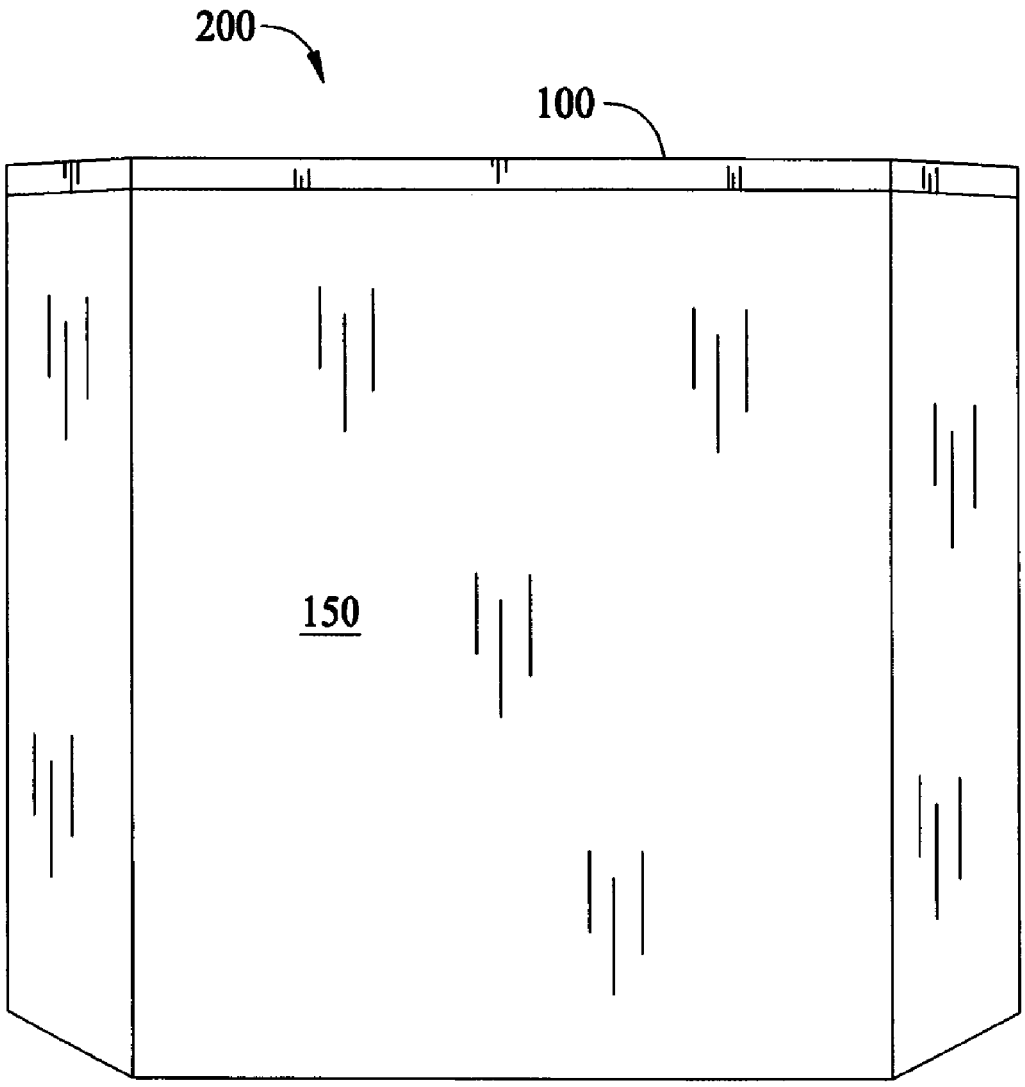
FIG. 7 is a side elevation of the erected bulk bin with plastic sleeve in place.

After fully sliding sleeve 150 onto bin 100 (FIG. 5), now-composite bin 200 may be opened up and erected, in the otherwise usual manner, as shown in FIGS. 6 and 7. Most of the total tension applied to sleeve 150 is applied during the erecting process; relatively little of the tension applied to sleeve 150 occurs during the initial placement of sleeve 150 onto bin 100. While the amount of tension may vary depending upon the material and thickness of sleeve 150, as well as the dimensions and materials of the bin 100, it is believed that a suitable tension, resulting in a 1-2% inclusive, stretching of the sleeve material once bin 100 is erected, is appropriate. Composite bin 200 may then be used, collapsed, shipped, and re-raised, in the manner of conventional collapsible bulk bins, until such time as the sleeve has lost its ability to retain tension in the desired manner.

In an alternative process, which again may be performed manually, or, more effectively, by machinery, suitably adapted by one of ordinary skill in the art, having the present disclosure before them, collapsed bin 100 is kept in an unbowed configuration, and sleeve 150 is stretched slightly, e.g., by rods or paddles applying outward lateral force on the corner regions of the sleeve. Once sleeve 150 has been sufficiently stretched, then bin 100 may be inserted into sleeve 150.

Further alternative methods may comprise varying combinations of these two principal methods described hereinabove.

Figure 8:
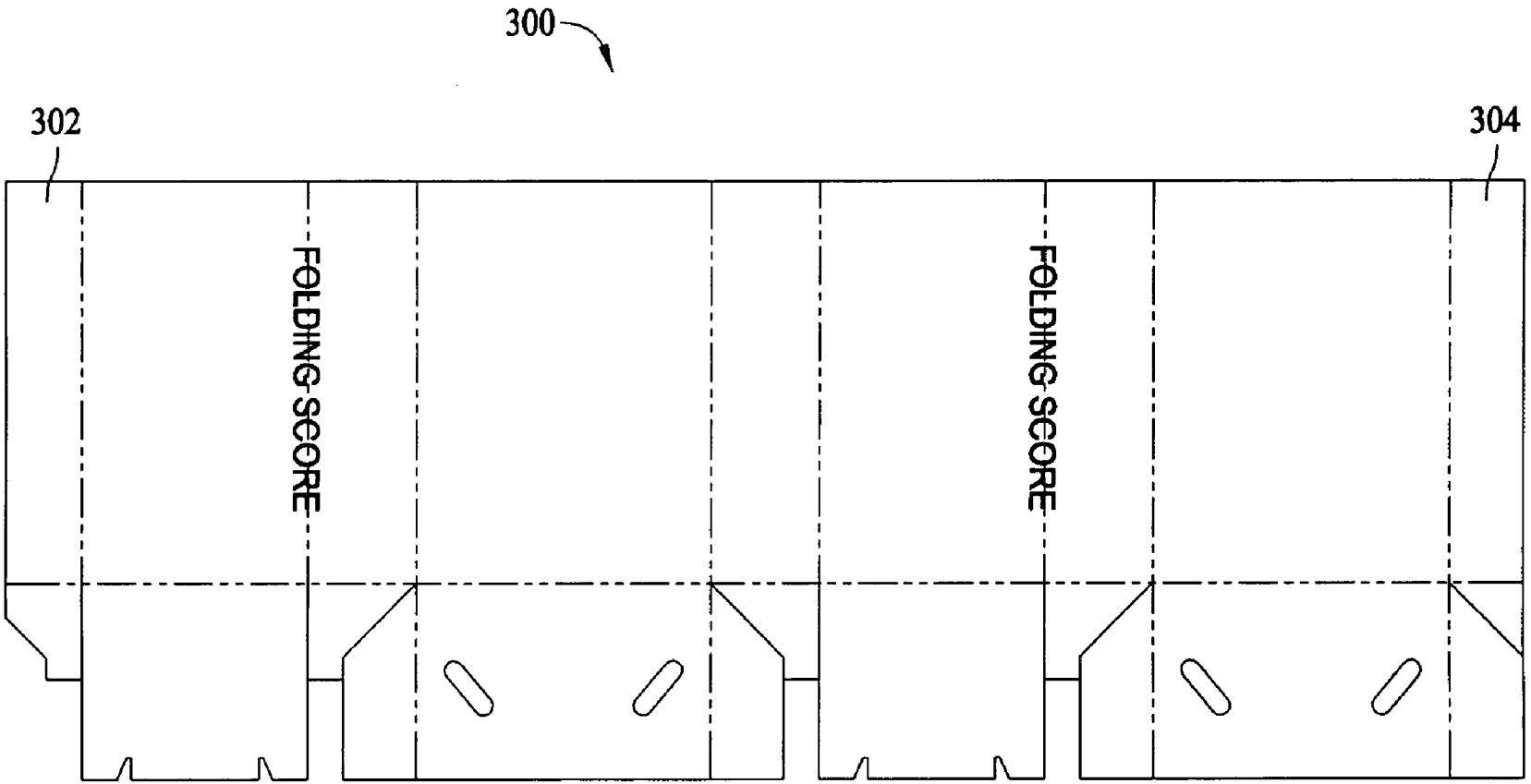
FIG. 8 is a plan view of a blank for another bulk bin which may be used in the present invention.
Figure 9:
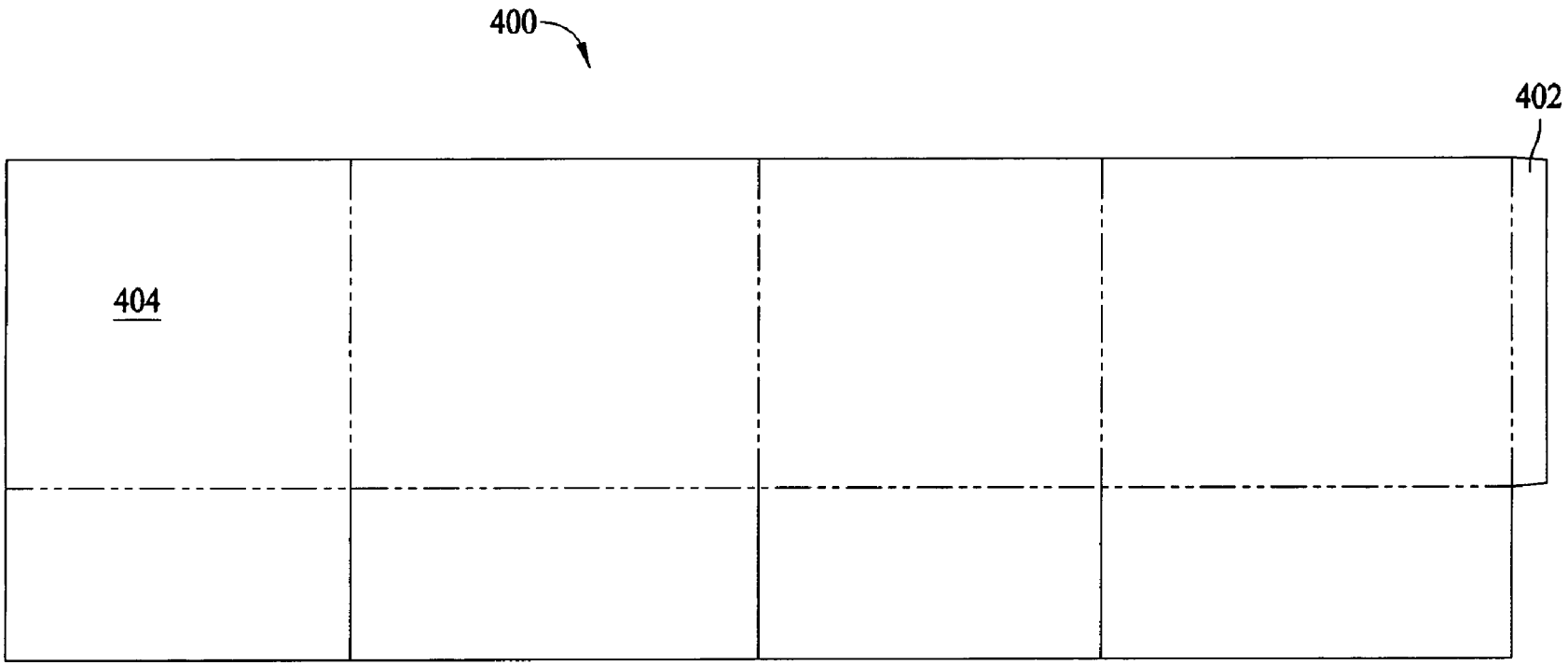
FIG. 9 is a plan view of a blank for still another bulk bin which may be used in the present invention.

FIGS. 8 and 9 illustrate alternative bulk bin blanks, which may also be used with plastic sleeves, in accordance with the principles of the present invention. Blank 300 of FIG. 8 represents another octagonal bin design, featuring flaps 302 and 304, which overlap to form the manufacturer's joint. Blank 400 of FIG. 9 represents a rectangular bulk bin configuration, wherein flap 402 is glued to the inside or outside of wall 404, to form the manufacturer's joint.

It is to be understood that while octagonal and rectangular (as seen from above) bulk bins are discussed herein, in association with the reinforcing material, the principles of the present invention may be applied to bulk bins of substantially any cross-sectional configuration, provided that the bin may be collapsed into a flat or substantially flat collapsed configuration, to permit placement of the reinforcing sleeve.

Further, while a single reinforcing sleeve, having a height equal to or substantially equal to the height of the side walls of the bulk bin is illustrated, the reinforcing sleeve may have a height substantially less than the height of the corresponding bulk bin side walls may be employed. Alternatively, a plurality of reinforcing sleeves may be provided that are vertically spaced from one another, or partially or entirely overlapping one another.

The foregoing description and drawings merely explain and illustrate the invention, and the invention is not so limited as those skilled in the art who have the disclosure before them will be able to make modifications and variations therein without departing from the scope of the invention.

What is claimed is:

1. A composite, reinforced, collapsed bulk bin assembly capable of being erected to a deployed, articulated configuration, said bulk bin assembly comprising:

a bulk bin body in a collapsed configuration, said bulk bin body comprising at least one bottom panel and a plurality of side walls, the plurality of side walls operably configured to be disposed substantially perpendicular to the at least one bottom panel when the bulk bin body is in a deployed configuration, the collapsed configuration including some of the side walls in juxtaposed, overlying, parallel orientation relative to remaining ones of the side walls, the bulk bin body having an outside circumference defined by the plurality of side walls; and a stretchable reinforcing sleeve that is configured to provide substantially evenly distributed support along each of the plurality of side walls, the reinforcing sleeve having a circumference that is less than the outside circumference of the bulk bin body when the reinforcing sleeve is in an unstressed state, the reinforcing sleeve attached about the plurality of side walls of the bulk bin body, wherein the reinforcing sleeve is stretched, relative to the unstressed state of the reinforcing sleeve to attach the reinforcing sleeve to the bulk bin body, attaching the reinforcing sleeve about the bulk bin body comprises:

bowing the bulk bin body such that a chord distance between opposing edges of the bowed bulk bin body is substantially less than a corresponding distance between opposed edges of the bulk bin body when in an unstressed configuration;

sliding the reinforcing sleeve onto the bowed bulk bin body; and releasing the bowed bulk bin body to permit the bulk bin body to return to its unstressed configuration.

2. The composite, reinforced collapsed bulk bin assembly according to claim 1, wherein the reinforcing sleeve is stretched by an amount of about one percent to about two percent, inclusive, of an unstressed circumference of the reinforcing sleeve when the composite, reinforced collapsible bulk bin is in the deployed, articulated configuration.

3. The composite, reinforced collapsed bulk bin assembly according to claim 1, wherein the bulk bin body is fabricated from at least one of paper, paperboard, and corrugated paperboard.

4. The composite, reinforced collapsed bulk bin assembly according to claim 1, wherein the reinforcing sleeve is fabricated from a substantially stretchable material comprising at least one of polyethylene and polypropylene.

5. The composite, reinforced collapsed bulk bin assembly according to claim 1, wherein the reinforcing sleeve comprises a monolithically formed, single extruded member, the extruded member cut off from a continuous tubular extrusion of reinforcing sleeve material.

6. The composite, reinforced collapsed bulk bin assembly according to claim 1, wherein the reinforcing sleeve comprises two seams extending in a direction substantially parallel to a vertically extending direction along the plurality of side walls of the bulk bin body.

7. The composite, reinforced collapsed bulk bin assembly according to claim 1, wherein the bulk bin body is configured to have a polygonal cross-section when in the deployed configuration.

8. The composite, reinforced collapsed bulk bin assembly according to claim 1, wherein the reinforcing sleeve comprises a seamless, tubular portion.

9. The composite, reinforced collapsed bulk bin assembly according to claim 1, wherein the at least one reinforcing sleeve is formed with a tubular portion, a sealed top end, and an open bottom end; and wherein the at least one reinforcing sleeve is attached about the bulk bin body by placing the reinforcing sleeve snugly about the plurality of side walls of the bulk bin body, including placing the bulk bin body within the open end of the reinforcing sleeve such that the sealed end of the reinforcing sleeve covers an open top end of the bulk bin body to reduce moisture intrusion into the bulk bin body prior to loading the bulk bin body, the sealed end of the reinforcing sleeve is configured to be unsealed to allow for loading of the bulk bin body.

10. The composite, reinforced collapsed bulk bin assembly according to claim 1, wherein the bulk bin body has a height defined by the plurality of side walls, and wherein the reinforcing sleeve comprises a tubular portion having a height substantially equal to the height of the bulk bin body.

11. The composite, reinforced collapsed bulk bin assembly according to claim 1, wherein the bulk bin body has a height defined by the plurality of side walls, and wherein the reinforcing sleeve comprises a tubular portion having a height substantially less than the height of the bulk bin body.

12. The composite, reinforced collapsed bulk bin assembly according to claim 1, wherein the bulk bin body has a height defined by the plurality of side walls, and wherein the reinforcing sleeve covers at least half of the height of the bulk bin body distributing the support substantially evenly over more than half of the height of the plurality of side walls.

* * * * *

UNITED STATES PATENT AND TRADEMARK OFFICE

CERTIFICATE OF CORRECTION

PATENT NO. : 7,651,024 B2
APPLICATION NO. : 11/476271
DATED : January 26, 2010
INVENTOR(S) : James Watson Barner It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 173 days.

Signed and Sealed this

Twenty-eighth Day of December, 2010

David J. Kappos

David J. Kappos
*Director of the United States Patent and Trademark Office*